United States Patent [19]

McKenna

[11] B 3,997,428

[45] Dec. 14, 1976

[54] VAPORIZATION OF OIL FEED BY ADDITION OF REGENERATED CATALYST

[75] Inventor: George E. McKenna, Borger, Tex.

[73] Assignee: Phillips Petroleum Company, Bartlesville, Okla.

[22] Filed: May 6, 1974

[21] Appl. No.: 467,250

[44] Published under the second Trial Voluntary Protest Program on February 3, 1976 as document No. B 467,250.

[52] U.S. Cl. ..... 208/78; 208/113; 208/120; 208/159; 208/164

[51] Int. Cl.[2] ..... C10G 37/02; C10G 11/04

[58] Field of Search ..... 208/78, 113, 120

[56] References Cited

UNITED STATES PATENTS

| | | | |
|---|---|---|---|
| 2,755,231 | 2/1956 | Blanding et al. | 208/120 |
| 3,042,196 | 7/1962 | Payton et al. | 208/113 |
| 3,186,805 | 6/1965 | Gomory | 23/288 |
| 3,380,911 | 4/1968 | Owen | 208/74 |
| 3,639,228 | 2/1972 | Carr et al. | 208/153 |
| 3,801,493 | 4/1974 | Youngblood et al. | 208/78 |

*Primary Examiner*—Delbert E. Gantz
*Assistant Examiner*—G. E. Schmitkons

[57] ABSTRACT

In the catalytic cracking of oil, especially in a riser-type of transport pipe reactor, feedstock in the liquid state is added to the reactor together with sufficient regenerated catalyst to effect essentially complete vaporization of the oil but with minimum cracking. Preferably the regenerated catalyst is cooled to about 900° to 1100° F prior to contact with the oil. The mixture of oil and catalyst is propelled through the riser until the oil is substantially vaporized and then a major portion of hot regenerated catalyst is added to effect the cracking reaction.

9 Claims, 1 Drawing Figure

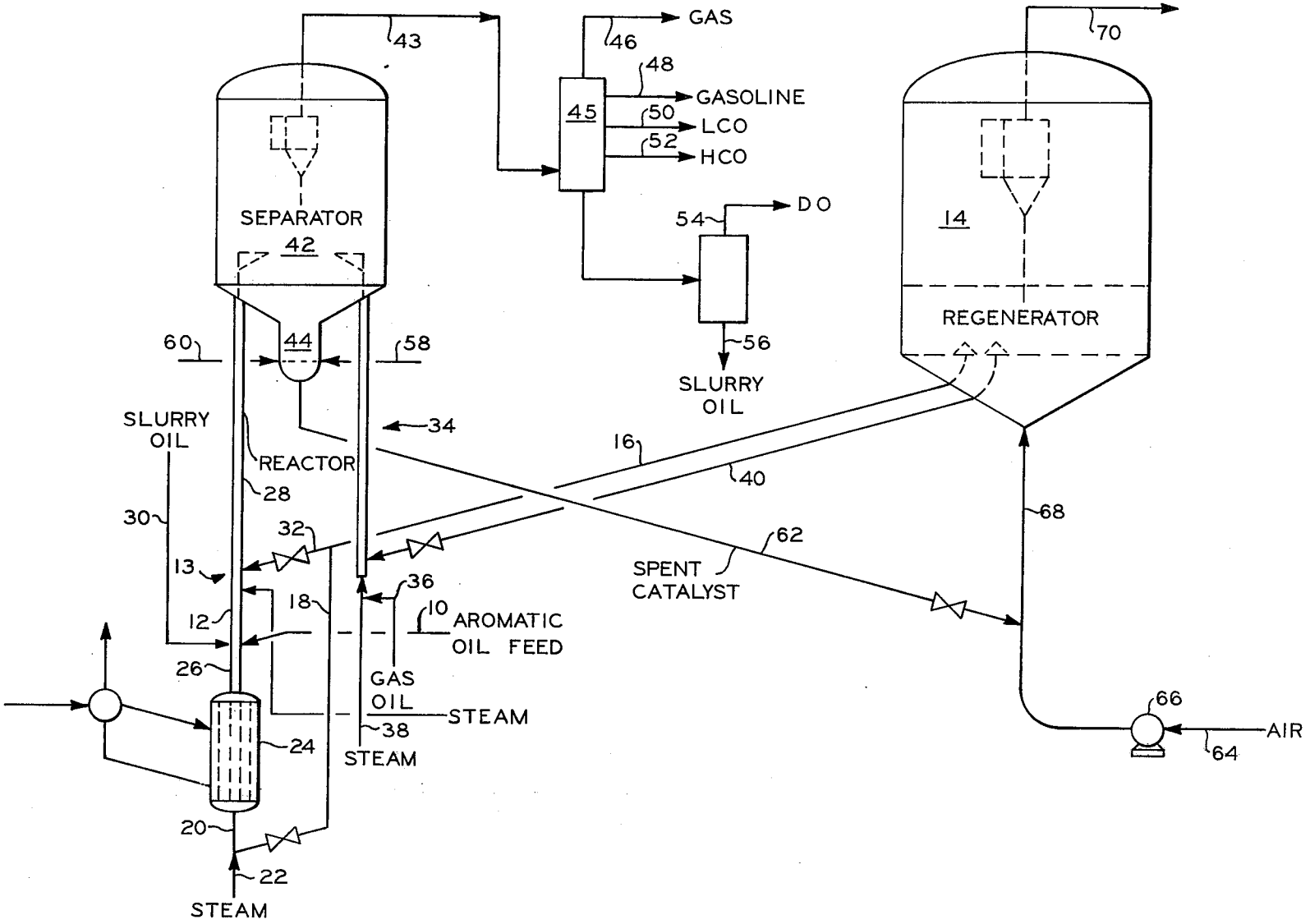
AIR
64
66
70
68
14
REGENERATOR
GAS
46
48
GASOLINE
50
LCO
52
HCO
45
54
DO
56
SLURRY OIL
40
62
SPENT CATALYST
16
43
58
34
10
AROMATIC OIL FEED
36
STEAM
GAS OIL
38
STEAM
SEPARATOR
42
44
REACTOR
28
32
18
24
22
STEAM
60
SLURRY OIL
30
13
12
26
20

VAPORIZATION OF OIL FEED BY ADDITION OF REGENERATED CATALYST

SUMMARY OF THE INVENTION

This invention relates to the catalytic conversion of oil to more valuable lower boiling products.

It is an object of this invention to avoid coke laydown on catalysts; it is further an object of this invention to simplify catalytic cracking of oil feedstocks by eliminating the need to separate extraneous materials; it is yet a further object of this invention to allow conversion to take place after most of the oil feed is in a vapor state; it is still yet a further object of this invention to increase the operable catalyst to oil ratio in the cracking zone; and it is still yet a further object of this invention to vaporize oil with active catalyst without effecting significant cracking during the vaporization. Also an important objective is to minimize cracking of desirable products after they have been formed to give coke and gas, by optimizing the control of reaction.

In accordance with this invention, regenerated catalyst at a temperature within the range of 900°–1100°F, is utilized to vaporize an oil feedstock prior to introduction of additional catalyst to effect conversion of the vaporized oil.

BRIEF DESCRIPTION OF THE DRAWING

The drawing is a schematic representation of a catalytic conversion process utilizing the instant invention.

DESCRIPTION OF THE PREFERRED EMBODIMENT

The invention is broadly applicable to any catalytic conversion process for converting liquid oil feedstocks to lower molecular weight products. However, it is of primary utility in catalytic cracking processes for refractory oils utilizing a riser-type of transport pipe reactor either alone or in conjunction with a second pipe reactor for the conversion of gas oil (less refractory oils) at a slightly lower temperature. Catalytic conversion processes for the conversion of hydrocarbon oils are broadly known in the art as shown by Payton et al, U.S. Pat. NO. 3,042,196 issued July 3, 1962.

In accordance with the invention, the reactor comprises two zones, a vaporization zone, which in the preferred embodiment is at the bottom of a riser reactor, and a reaction or cracking zone which constitutes the upper portion of the riser reactor. Oil together with sufficient regenerated catalyst to effect essentially complete vaporization of the oil with minimum cracking is added in the vaporization zone.

In the preferred embodiments, the regenerated catalyst added at this point is preferably cooled slightly to a temperature of 900°-1100°F. There is, of course, an interrelationship between the temperature of the regenerated catalyst and the amount added since the vaporization is effected by means of direct heat exchange between the catalyst and the oil. Thus, it is possible to use catalyst which is in itself still at a temperature at which catalytic conversion would occur, but since it is immediately cooled on contact with the oil which can be at ambient temperature, little or no cracking does occur. Thus there is considerable leeway in the temperature of the regenerated catalyst added at this point, the essential feature being that the temperature of the oil is raised to approximately 700°–800°F to vaporize the oil with minimum of cracking of liquid oil, and the catalyst is at no more than 1100°F; under these conditions as noted hereinabove, even though the catalyst may be at a temperature where it would otherwise effect conversion, the oil is vaporized and the catalyst cooled prior to any appreciable cracking or conversion taking place in the liquid phase. Since it is cracking of oil in the liquid phase that results in high deposits of coke on the catalyst, this problem is drastically reduced in accordance with the invention. Nonetheless, since the catalyst is regenerated catalyst, it is effective in causing conversion in the reaction zone. Thus to minimize coke deposit, it is necessary to avoid contact of the oil while still in the liquid phase with all of the catalyst.

The vaporized oil and catalyst are advanced to the reaction zone preferably in the presence of steam where a major portion of regenerated catalyst at a temperature within the range of 1050°F to 1350°F is added. Preferably a slurry oil at a temperature of 600°–800°F is added. It is best to inject slurry oil in the vaporizing zone rather than in the zone where cracking is to take place, thus to vaporize the slurry oil before most of the cracking takes place. The effluent from this reaction zone goes to a separation or catalyst disengaging zone where spent catalyst is removed from the bottom thereof and the hydrocarbon vapor product is removed from the top.

In the preferred embodiment wherein slurry oil is added, the slurry oil (containing catalyst which was carried along with the hydrocarbon vapor to the fractionation zone) is readily vaporized. Better mixing and cracking is obtained along with better product distribution when the original feedstock and the slurry oil are in the vapor state.

The catalyst can be any commercial silica-containing cracking catalyst such as crystalline alumina silicates, composites of silica with one or more metal oxides, such as alumina, zirconia, magnesia and the like. Commercial zeolite-type or molecular-sieve-type catalysts having a particle size in the range of 5 to 100 microns are suitable.

Operation under the above defined conditions constitutes the best mode for carrying out the invention and produces very favorable conversions of from 50 to 80 liquid volume percent, conversion being defined as 100 minus the liquid volume percent of cycle oil; the products of conversion include gaseous products, gasoline stocks and coke. Contact times may vary, but are generally in the range of 5 to 15 seconds. Within the first riser reactor, the amount of steam is usually within the range of 5 to 20 pounds per barrel of said hydrocarbon feed. The pressure within the first riser reactor can be within the range of 5 to 25 psig.

The regenerator can be operated at a temperature within the range of 1050° to 1350°F. In this zone, the contaminated catalyst particles are contacted with air or other suitable oxidizing gas which at this temperature effects regeneration of the catalyst and restoration of its cracking activity by the oxidization or burning of combustible contaminants such as coke deposits therefrom. Generally, the spent catalyst will contain 1.5 to 3 weight percent coke and regenerated catalyst will generally have less than one weight percent coke, e.g., 0.05 weight percent coke.

Referring to the figure, the charging oil, which may be an aromatic in a liquid state, generally at ambient temperature, or within the range of 50° to 500°F, is supplied through line 10 to the vaporizing zone 12 in which it is intimately contacted with sufficient cooled regenerated catalyst at a temperature within the range of 900° to 1100°F, preferably in the presence of steam to effect complete vaporization of the oil, but with minimum cracking. Part of the regenerated catalyst from the regenerator 14 is passed via line 16 and 18 to line 20 where steam from line 22 is added and the thus formed mixture enters a cooler 24 to cool the regenerated catalyst from a temperature in the regenerator which is generally in the range of about 1050° to 1450°F. Preferably this temperature in the regenerator is as high as equipment will permit which is generally at least 1350°F. At this temperature it is possible to effect best regeneration and minimum coke residual. The catalyst is cooled down to a temperature within the range of 900° to 1100°F, preferably within the range of 950° to 1050°F. Catalyst cooler 24 also has water or other heat exchange material circulating therethrough to provide additional cooling by means of indirect heat exchange so as to achieve the temperature of 900° to 1100°F. Leaving cooler 24 via line 26, the steam and regenerated catalyst at a temperature as low as possible and still vaporize the oil and generally about 900° to 1100°F enters the vaporization zone 12 together with oil from line 10. The oil is preheated and vaporized to an equilibrium temperature of about 700°–800°F without substantial cracking in vaporizing zone 12 by its contact with the regenerated catalyst. This mixture of regenerated catalyst and vaporized oil at about 700°–800°F enters directly to the reaction zone 28 of the riser reactor 13 where it is intimately contacted with a large volume of hot slurry oil at about 600° to 800°F from line 30 and a large volume of regenerated catalyst at a temperature of 1050° to 1350°, from line 32 to heat the feedstocks to a cracking temperature within the range of 950° to 1100°F depending on the desired severity. The operating conditions of time, steam addition, pressure, and conversion or residence time in reaction zone 28 are regulated to effect substantially complete catalytic cracking of the oil as is known in the art.

The use of regenerated catalyst to preheat and vaporize the oil in vaporization zone 12 increases the catalyst/oil weight ratio in the cracking zone 28 by some 5 to 10 units compared with a conventional cracking unit with a furnace preheat section, thus improving cracking results and effecting lower space velocity, which allows for more conversion at the same temperature. Preferably the catalyst to oil ratio in reactor 28 will be within the range of 15:1 to 30:1, preferably within the range of 17:1 to 25:1.

The riser reactor having zones 12 and 28 can be used with another riser reactor 34 for cracking less refractory oils such as gas oil or topped crude supplied through line 36 with steam being supplied through second steam line 38 and regenerated catalyst through second regenerated catalyst line 40. However it would be desirable to apply the prevaporization principle here too.

In accordance with the most preferred embodiment of the invention, the most refractory or most difficult to crack oil to be cracked is introduced into riser reactor 13 while the least refractory oil is introduced into riser reactor 34. Among the highly refractory oils are the aromatics, e.g., material produced by solvent refining of at least a portion of light and/or heavy cycle oils and/or decant oil or slurry oil processed in the system. Among the least refractory oils are the virgin gas oils (paraffinic) and/or raffinates (paraffinic) produced e.g., by solvent extraction of the above referred to cycle oils and decant oils. Topped or reduced crude oils are the least refractory oils and are cracked in riser reactor 34.

The spent or partially spent catalyst and cracked product from riser reactors 13 and 34 enter a separation zone 42 wherein substantially all of the catalyst particles are separated from the hydrocarbon conversion products. The catalyst is collected and steam stripped in zone 44 and the fluid hydrocarbon conversion products in the form of vaporous and gaseous hydrocarbons are directed from separation zone 42 via line 43 where the hydrocarbon products are separated in fractionation zone 45 into the desired liquid fractions and the gas which is removed via line 46, gasoline which is removed via line 48, light cycle oil which is removed via line 50, heavy cycle oil which is removed via line 52, decant oil which is removed via line 54, and slurry oil which is removed via line 56 and returned to line 30.

Spent catalyst particles are directed from steam stripping zone 44, stripping steam being injected via lines 58 and 60, through line 62 wherein the catalyst particles are picked up by an incoming stream of air or other oxidizing gas supplied through line 64 and blower 66 and are transported via line 68 to regenerator 14, wherein the coke content of the catalyst is reduced to a desired lower level.

After regeneration in zone 14 through contact with air or other suitable oxidizing gas at a sufficiently high temperature to effect restoration of the cracking activity, the gaseous products or flue gases of the regeneration are removed via line 70. The regenerated catalyst separated from the combustion gases is directed through lines 16 and 32 to the reaction zone 28 and part of the regenerated catalyst is directed through lines 16, 18 and 20 to the vaporizing zone 12 of riser reactor 13. Also, regenerated catalyst from zone 14 is directed via line 40 to riser reactor 34 for cracking either gas oil or topped crude.

Many conventional parts such as temperature controllers, motors, frame elements, and the like have been omitted from the drawing for the sake of simplicity, but their inclusion is understood by those skilled in the art and is within the scope of the invention.

CALCULATED ILLUSTRATIVE EMBODIMENT

Utilizing an apparatus such as that described in the drawing, approximately 1350°F regenerated catalyst is withdrawn from a regenerator operated at about 1350°F and separated into two streams, a first stream of 1.5 tons per minute going to a catalyst cooler and a second stream of 17.5 tons per minute going to about a midpoint of a vertical pipe riser reactor, these amounts being varied as needed. About five thousand pounds per hour of steam is introduced along with the first portion of spent catalyst and about 7500 pounds per hour of water is circulated through an indirect heat exchanger to aid in cooling the catalyst to a temperature of about 1000°F at which point said catalyst first contacts aromatic oil which is introduced at a temperature of about 100°F into lower portion of a vaporization zone of said riser reactor at about 100 barrels per hour. The temperature in the vaporization zone is about 750°F. About three hundred barrels per hour of slurry oil at about 650°F is introduced into said midpoint and is vaporized and passes upwardly with said first and second portions of regenerated catalyst and said aromatic oil through a reaction zone of said riser reactor which is operated at a temperature of about 1025°F. Resulting products and catalyst are introduced into a separation zone and the vapor removed and are conventionally separated into gas, gasoline, light cycle oil, heavy cycle oil, decant oil, and slurry oil, which slurry oil is recycled to form part of said 300 barrels per hour of slurry oil which is introduced into said midpoint of said riser reactor. Said catalyst after steam stripping occluded hydrocarbons therefrom is removed from a bottom portion of said reactor and conveyed by means of a stream of air into said regeneration zone. About ten thousand pounds per hour of steam and about 1400 barrels per hour of gas oil at about 775°F are introduced into a second riser reactor along with about 14.5 tons per minute of catalyst to give a temperature of about 925°F where said gas oil is cracked and the products introduced into said separator. Specifically, the catalyst employed is zeolite type silica-alumina cracking catalyst, the aromatic oil is extract oil from $SO_2$ or other solvent extraction of the cycle oils, the slurry oil is the catalyst-containing residue oil from fractionation of the cracked products, and the gas oil is a virgin gas oil recovered from crude oil, and has an API gravity at 60°F of about 30.

While this invention has been described in detail for the purpose of illustration, it is not to be construed as limited thereby, but is intended to cover all changes and modifications within the spirit and scope thereof.

What is claimed is:

1. A hydrocarbon conversion process comprising:

combining a first portion of a regenerated silica-containing cracking catalyst at a temperature within the range of about 900° to 1100°F with an oil feed at a temperature of about 50° to 200°F so as to vaporize said oil feed without substantial cracking and bring said feed to a temperature within the range of about 700°–800°F;

thereafter adding additional regenerated catalyst at a temperature within the range of about 1050 to 1350°F to increase the temperature of said oil to a level within the range of about 950 to 1100°F where cracking occurs;

separating the resulting products from spent catalyst produced thereby;

recycling said spent catalyst to a regeneration zone; and recovering said products.

2. A process according to claim 1 wherein said oil feed is an aromatic and wherein there is added in addition a slurry oil along with the major portion of the regenerated catalyst.

3. A method according to claim 1 wherein the weight ratio of catalyst to oil where said cracking occurs is within the range of 15:1 to 30:1.

4. A method according to claim 1 wherein said catalyst is silica-alumina.

5. A method according to claim 1 wherein said products are separated into gas, gasoline, light cycle oil, heavy cycle oil, decant oil, and slurry oil which is recycled to said reaction zone.

6. A method according to claim 1 wherein said vaporization zone and reaction zones are sequential portions of a vertical pipe.

7. A method according to claim 1 wherein said regenerated catalyst which is added to said vaporization zone is cooled by an exchanger and the introduction of steam at a temperature within the range of about 950° to 1050°F prior to contact with said oil feed.

8. A method according to claim 7 comprising in addition introducing another portion of regenerated catalyst and gas oil into a second reaction zone in the form of a vertical riser reactor along with steam to effect conversion of said gas oil.

9. A method according to claim 8 wherein said oil feed is a relatively high refractory oil and wherein said gas oil is a relatively low refractory oil.

* * * * *